US005591049A

United States Patent [19]

Dohnishi

[11] Patent Number: 5,591,049

[45] Date of Patent: Jan. 7, 1997

[54] HIGH VOLTAGE CONNECTOR

[75] Inventor: Kiyoyuki Dohnishi, Kyoto, Japan

[73] Assignee: Murata Manufacturing Co., Ltd., Nagaokakyo, Japan

[21] Appl. No.: 421,939

[22] Filed: Apr. 14, 1995

[30] Foreign Application Priority Data

Apr. 21, 1994 [JP] Japan ..... 6-083352

[51] Int. Cl.[6] ..... H01R 13/424

[52] U.S. Cl. ..... 439/595; 439/352

[58] Field of Search ..... 439/595, 352

[56] References Cited

U.S. PATENT DOCUMENTS

| | | | |
|---|---|---|---|
| 3,727,172 | 4/1973 | Clark | 439/595 |
| 3,838,382 | 9/1974 | Sugar | 439/595 |
| 4,358,179 | 11/1982 | Bourdon et al. | 439/595 |
| 4,806,123 | 2/1989 | Konishi et al. | 439/595 |
| 5,071,369 | 12/1991 | Denlinger et al. | 439/595 |
| 5,100,345 | 3/1992 | Endo et al. | 439/595 |

*Primary Examiner*—Stephen P. Garbe

*Attorney, Agent, or Firm*—Burns, Doane, Swecker & Mathis, LLP

[57] ABSTRACT

A high-voltage connector for use on a device such as a flyback transformer or the like has a high-voltage lead wire having a metal cap fixed to one end thereof, and a connector sleeve on the body of the device, having a bore for receiving the high-voltage lead wire. The connector sleeve is provided therein with stopper claws for retaining the metal cap against withdrawal of the high-voltage lead wire, thereby retaining the high-voltage lead wire in the connector sleeve. The high-voltage connector further has a cylindrical disengaging member having a bore receiving the high-tension lead wire. The disengaging member includes a pair of cylindrical members having opposing ends forming an interdigitating portion.

12 Claims, 3 Drawing Sheets

HIGH VOLTAGE CONNECTOR

BACKGROUND

1. Field of the Invention

The present invention relates to a high-voltage connector and, more particularly, to a high-voltage connector for use in a flyback transformer or a CR block in an apparatus or device which operates at a high voltage, such as a projection television.

2. Description of the Related Art

A problem encountered by conventional systems will be described with specific reference to FIG. 5. Therein, a conventional high-voltage connector 20 for use in a flyback transformer has a connector sleeve 22 projected from a casing 21 of the main part of the flyback transformer. A retainer projection 23 for preventing unintentional withdrawal of a later-mentioned high-voltage lead wire is formed on the inner surface of the connector sleeve 22. A terminal 24 having a hole 24*a* fits in the connector sleeve 22. The terminal 24 is connected through a diode 25 to a coil (not shown) in the casing 21. The above-mentioned high-voltage lead wire, denoted by reference numeral 26, is connected at one end to the anode of a cathode ray tube of a projection television (not shown), while the other end is provided with a metal cap 27 fixed thereto by soldering or caulking. The metal cap 27 has a core wire 27*a* projecting from one end thereof, and is provided on the outer peripheral surface thereof with an anchoring projection 27*b* which engages with the retainer projection 23 when forced to pass over the retainer projection 23, as will be described later.

In the assembly of this high-voltage connector 20, the high-voltage lead wire 26 is inserted and pressed into the connection sleeve 22 so that the metal cap 27 is moved beyond the retainer projection 23 so as to bring the core wire 27*a* on the metal cap 27 into engagement with the hole 24*a* in the terminal 24. During this movement of the metal cap 27, the anchoring projection 27*b* on the metal cap 27 is forced to elastically deform radially inward to pass through the bore defined by the retainer projection 23. The anchoring projection 27*b*, once it has passed through the above-mentioned bore, engages with the retainer projection 23 due to its elastic restoration force, so as to anchor the metal cap 27 against any force which acts in the extracting direction, i.e., leftward as viewed in FIG. 5. Consequently, the high-voltage lead wire 26 is firmly held in the connector sleeve 22, while maintaining the electrical connection to the coil in the casing 21 through the terminal 24 and the diode 25.

This known arrangement suffers from the following problem. Maintenance of the projection television may require replacement of the cathode ray tube which is connected to the outer end of the high-voltage lead wire 26. Replacement of the cathode ray tube connected to the outer end of the high-voltage lead wire 26 requires extraction of the high-voltage lead wire 26 from the connector sleeve 22 on the flyback transformer. Extraction of the high-voltage lead wire 26 from the connector sleeve 22, however, is hindered because the anchoring projection 27*b* on the metal cap 27 engages with the retainer projection 23 so as to prevent the metal cap 27 and, hence, the lead wire 26 from moving in the direction of extraction. It might be possible to separate the cathode ray tube from the flyback transformer by cutting the high-voltage lead wire 26. In such a case, however, the metal cap 27 undesirably remains in the connector sleeve 22.

Consequently, replacement of the flyback transformer itself becomes necessary.

SUMMARY

Accordingly, an object of the present invention is to provide a high-voltage connector which permits easy connection and disconnection of a high-voltage lead wire.

To this end, according to the present invention, there is provided a high-voltage connector including: a high-voltage lead wire having a metal cap fixed to one end thereof; a connector sleeve for receiving the high-voltage lead wire, the connector sleeve being provided therein with stopper claws for retaining the metal cap against withdrawal of the high-voltage lead wire, thereby retaining the high-voltage lead wire in the connector sleeve; and a cylindrical disengaging member having a bore receiving the high-voltage lead wire, the disengaging member including a pair of cylindrical segments having opposing ends forming an interdigitating portion.

The overall axial length of the disengaging member can be varied by switching the state of the interdigitating portion between meshing and non-meshing conditions. When the interdigitating portion is set in the non-meshing condition, the overall length of the disengaging member is increased. In this state, the disengaging member is pushed into the connector sleeve beyond the position where the stopper claws are located, so that the stopper claws are resiliently deflected outward to release the metal cap, thus allowing the high-voltage lead wire to be easily withdrawn from the connector sleeve.

These and other objects, features and advantages of the present invention will become clear from the following description of the preferred embodiments when the same is read in conjunction with the accompanying drawings.

DETAILED DESCRIPTION

Figure 1A:
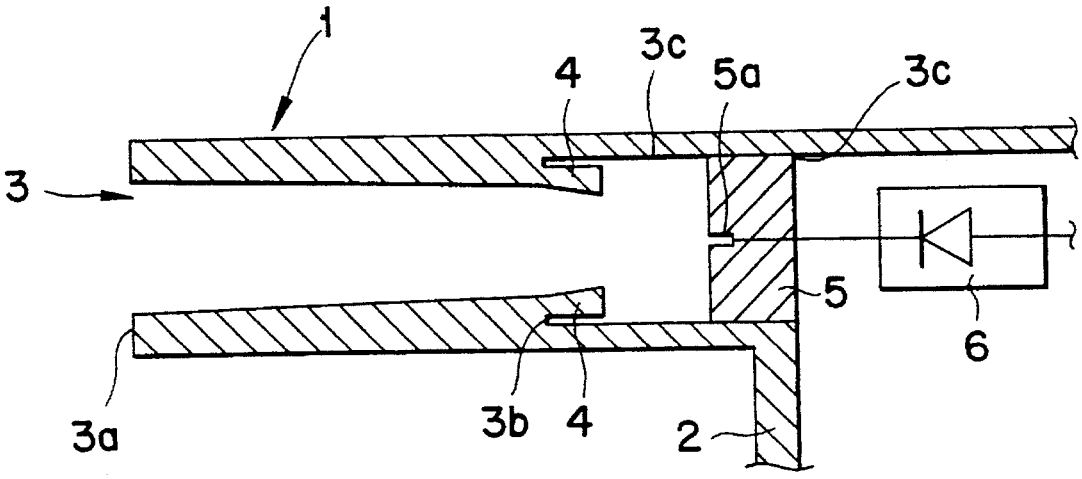
FIG. 1A is a sectional view of an exemplary embodiment of a high-voltage connector sleeve according to the present invention.

An exemplary embodiment of a high-voltage connector of the present invention will now be described with reference to the drawings. Referring to FIG. 1A, numeral 1 designates a connector sleeve which projects from a casing 2 of the main part of a flyback transformer. The connector sleeve 1 has a bore 3 the diameter of which progressively decreases from one open end 3*a* toward an intermediate step portion 3*b* and then extends at a constant diameter to the other end 3*c* in the casing 2. A pair of stopper claws 4, each having a substantially wedge-like cross-section, are formed on the inner surface of the connector sleeve 1 at the above-mentioned step portion 3*b*, so as to diametrically oppose each other. A terminal 5 having a hole 5*a* facing inward of the connector sleeve 1 fits in the above-mentioned open end 3*c* of the connector sleeve 1. The terminal 5 is connected to a coil (not shown) inside the casing 2, through a diode 6.

Figure 1B:
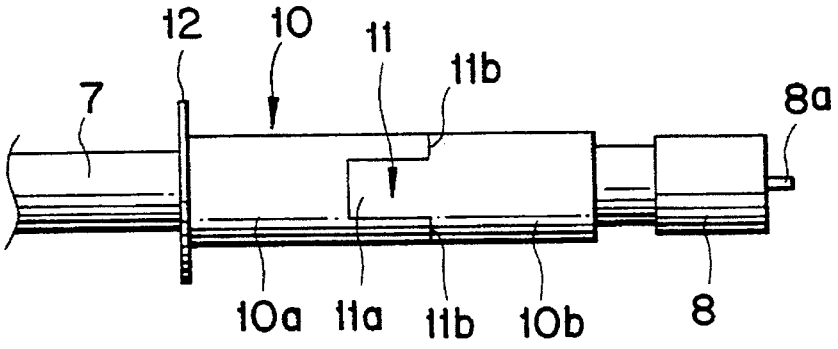
FIG. 1B is a side elevational view of a high-voltage lead wire usable in conjunction with the exemplary connector sleeve shown in FIG. 1A.

Referring now to FIG. 1B, a metal cap 8 having a core wire 8*a* on one end thereof is fixed to one end of a high-voltage lead wire 7 by, for example, soldering or caulking. The other end of the high-voltage wire 7 is connected to the anode (not shown) of the cathode ray tube of a projection television. This high-voltage lead line 7 is connected to the connector sleeve 1, thus forming a high-voltage connector 9.

Figure 2A:
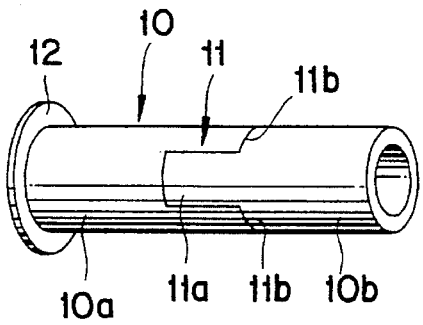
FIG. 2A is a perspective view of a disengaging member according to an exemplary embodiment of the present invention, in a state in which an interdigitating portion of the disengaging member is in the meshing condition.
Figure 2B:
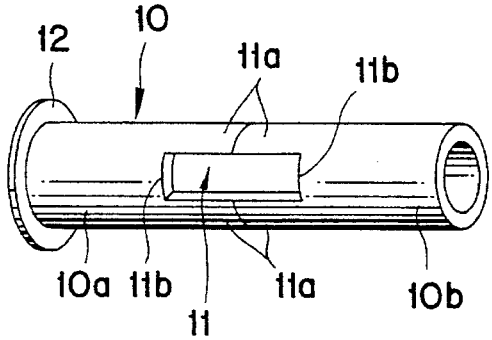
FIG. 2B is a perspective view of the disengaging member of FIG. 2A in which protrusions of the interdigitating portion abut each other.

The high-voltage lead wire 7 is received in a cylindrical disengaging member 10. The disengaging member 10 includes a pair of cylindrical segments 10*a* and 10*b* which can be made of an incombustible plastic such as polyphenylene oxide, polybutyleneterephthalate, polypropylene, polycarbonate or the like. These segments 10*a*, 10*b* are provided at their opposing ends with mating protrusions 11*a* and recesses 11*b* which in cooperation form an interdigitating portion 11. A circular flange 12 serving as a stopper is formed on the end of the cylindrical member segment 10*a* opposite to the interdigitating portion 11. The segments 10*a* and 10*b* are rotatable relative to each other, as will be seen from FIGS. 2A and 2B. The arrangement is such that, when the protrusions 11*a* are received in the recesses 11*b* as shown in FIG. 2A, the overall axial length of the disengaging member 10 provided by these segments 10*a*, 10*b* is equal to or less than the distance between the open end 3*a* and the step portion 3*b* of the bore in the connector sleeve 1, whereas, when the protrusions 11*a*, 11*a* on both segments abut each other as shown in FIG. 2B, the total axial length of the disengaging member 10 is greater than or equal to the distance between the open end 3*a* and the stopper claws 4.

Figure 3:
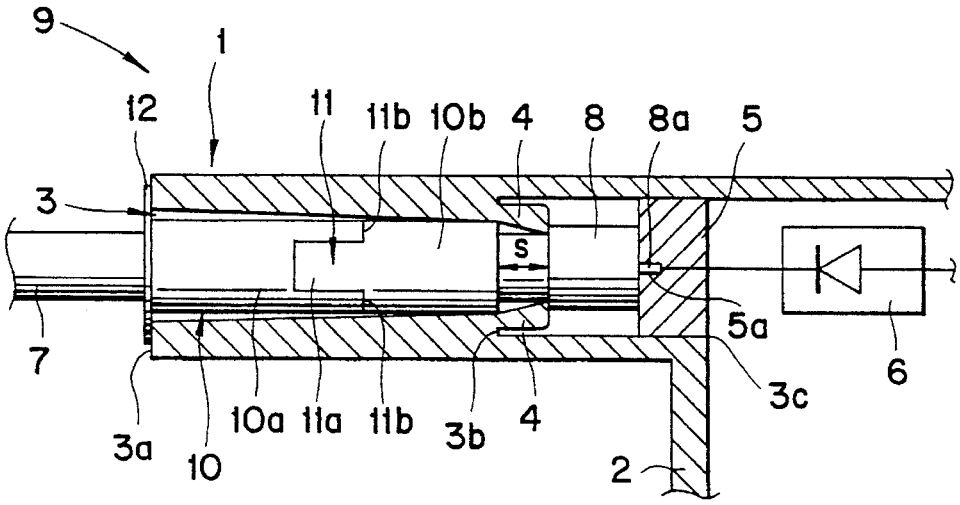
FIG. 3 is a sectional view of the exemplary embodiment shown in FIGS. 1A and 1B, in an assembled state with the high-voltage lead wire connected therein.

A description will now be given of operations for connecting and disconnecting the high-voltage lead wire 7 in a high-voltage connector 9 having the afore-described construction. For the purpose of connecting the high-voltage lead wire 7 to the connector sleeve 1, the relative rotational position between the pair of segments 10*a*, 10*b* of the disengaging member 10 is set such that the protrusions 11*a*, 11*a* on both segments 10*a*, 10*b* are received in the respective mating recesses 11*b*, 11*b* of both segments 10*a*, 10*b*, as shown in FIG. 3, so that a clearance "S" is formed between the metal cap 8 and the disengaging member 10. In this state, the high-voltage lead wire 7 is inserted into the connector sleeve 1, so that the metal cap 8 is forced to pass through the gap between the pair of the stopper claws 4, until the core wire 8*a* is brought into engagement with the hole 5*a* formed in the terminal 5. During this operation, the metal cap 8 advances into the connector sleeve 1 while outwardly deflecting the stopper claws 4. After passing the stopper claws 4, the stopper claws 4 resume their original positions due to their resiliency, thus stopping the metal cap 8 from movement in the direction of extraction. Consequently, the high-voltage lead wire 7 is firmly fixed in the connector sleeve 1 in electrical connection to the coil (not shown) in the casing 2 through the terminal 5 and the diode 6. In this state, the disengaging member 10 is held between the open end 3*a* and the step portion 3*b* of the bore in the connector sleeve 1, with the protrusions 11*a* and the recesses 11*b* on both segments 10*a*, 10*b* meshing with each other. The flange 12 prevents the segment 10*a* of the disengaging member 10 from moving further into the sleeve 1.

Figure 4:
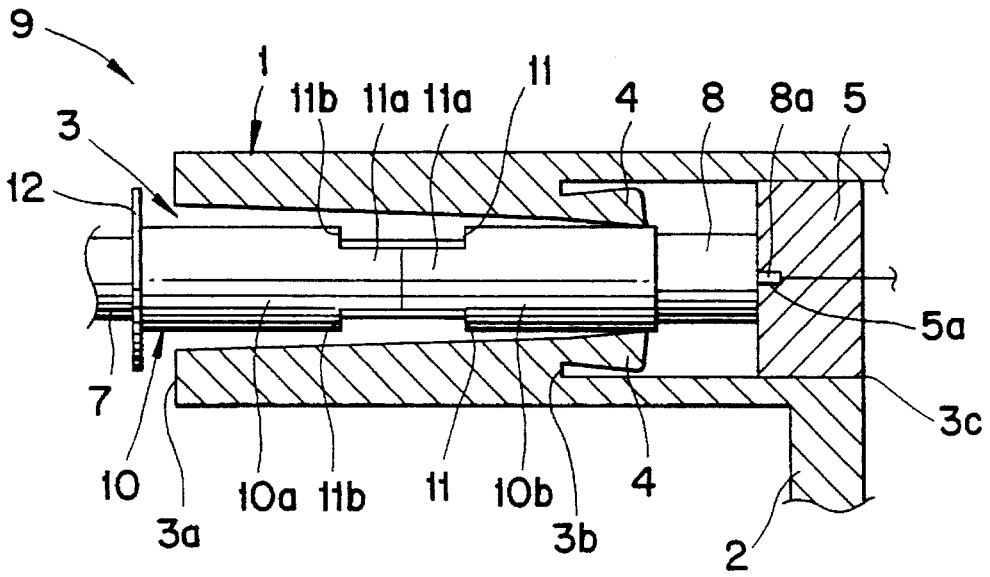
FIG. 4 is a sectional view of the exemplary embodiment shown in FIGS. 1A and 1B, in a state in which the high-voltage lead wire is ready to be extracted.
Figure 5:
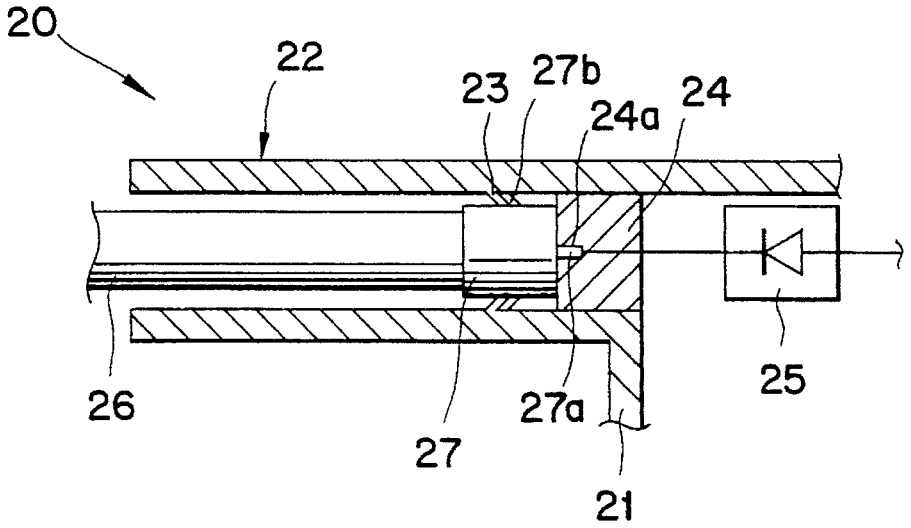
FIG. 5 (PRIOR ART)
FIG. 5 is a sectional view of a conventional high-voltage connector.

Referring now to FIG. 4, disconnection and extraction of the high-voltage lead wire 7 from the connector sleeve 1 is conducted by pulling the segment 10*a* of the disengaging member 10 out of the connector sleeve 10, rotating the segment 10*a* relative to the segment 10*b* such that the protrusions 11*a* on both segments 10*a*, 10*b* abut each other, and then pushing the segment 10*a* again into the connector sleeve 1. In this state, the overall axial length of the disengaging member 10 is greater than or equal to the distance between the open end 3*a* and an end portion of the stopper claws 4, so that inner end portion of the disengaging member 10 is moved inward beyond the stopper claws 4. In this state, the stopper claws 4 are resiliently urged away from the wire 7 and allow the metal cap 8 to move outward, so that the high-voltage lead wire 7 can be extracted from the connector sleeve 1 without difficulty.

It is thus possible to easily connect and disconnect the high-voltage lead wire 7 to and from the terminal 5 in the connector sleeve 1. Replacement of the cathode ray tube of a projection television at the time of maintenance work, therefore, can be conducted in a shorter time simply by replacing the high-voltage lead wire 7 alone, without necessitating replacement of the flyback transformer which hitherto has been necessary due to the fact that the high voltage lead wire 7 cannot be withdrawn from the connector sleeve.

In the exemplary embodiment described above, the opposing ends of the segments 10*a*, 10*b* of the disengaging member 10 have a pair of protrusions 11*a* and a pair of recesses 11*b* which together form the interdigitating portion 11. This, however, is only illustrative and the number of the protrusions and recesses may be varied as desired, provided that the protrusions and recesses on these two segments are sized and shaped to mesh and abut with each other.

As has been described, the high voltage connector of the present invention enables a high voltage lead wire to be easily connected and disconnected to and from the terminal in the connector sleeve. Therefore, replacement of, for example, a cathode ray tube of a projection television, when necessitated during maintenance work, can be conducted at the cost of replacement of the high voltage lead wire alone, without requiring replacement of the devices such as a flyback transformer or a CR block connected to the cathode ray tube through the high voltage wire. Thus, the present invention offers a remarkable advantage of reducing both costs and working hours incurred and spent in the work.

The above-described exemplary embodiments are intended to be illustrative in all respects, rather than restrictive, of the present invention. Thus, the present invention is capable of many variations in detailed implementation that can be derived from the description contained herein by a person skilled in the art. All such variations and modifications are considered to be within the scope and spirit of the present invention as defined by the following claims.

What is claimed is:

1. A connector comprising:

a lead wire having a cap fixed to one end thereof;

a connector sleeve for receiving said lead wire, said connector sleeve being provided therein with biased protrusions for retaining said cap against withdrawal of said lead wire, thereby retaining said lead wire in said connector sleeve; and a disengaging member having a bore receiving said lead wire, said disengaging member including a pair of members having opposing ends forming an interdigitating portion.

2. The connector of claim 1 wherein said pair of members are rotatable relative to one another such that said interdigitating portion has a meshed state and an abutting state.

3. The connector of claim 2, wherein said disengaging member has a length which is less than or equal to a distance between an insertion end of said bore and a portion of said biased protrusions closest to said insertion end of said bore when said interdigitating portion is in said meshed state.

4. The connector of claim 2, wherein said disengaging member has a length which is greater than or equal to a distance between an insertion end of said bore and a portion of said biased protrusions furthest from said insertion end of said bore when said interdigitating portion is in said abutting state.

5. The connector of claim 1 further comprising a flange connected to one of said pair of members.

6. The connector of claim 1 wherein said biased protrusions are stopper claws.

7. The connector of claim 1 wherein said connector sleeve is formed of an incombustible material.

8. A connector comprising:

a connector sleeve for receiving a cap connected to a wire, said connector sleeve being provided therein with protrusions biased to retain said cap against withdrawal thereof, thereby retaining said wire in said sleeve; and disengaging means for forcing said protrusions away from said cap to allow removal of said wire from said sleeve, including means for rotatably adjusting a length thereof to extend the disengaging means so as to contact said protrusions to disengage said protrusions from said cap.

9. The connector of claim 8, wherein said disengaging means further comprises two members which have alternating extensions and recesses allowing the two members to abut in a meshed or unmeshed state.

10. The connector of claim 7 further comprising a flange connected to one of said two members.

11. The connector of claim 8 wherein said protrusions are stopper claws.

12. The connector of claim 8 wherein said connector sleeve is formed of an incombustible material.

* * * * *